United States Patent [19]

McCullough

[11] Patent Number: 4,673,045

[45] Date of Patent: Jun. 16, 1987

[54] ENHANCED CIRCULATION DRILL BIT

[76] Inventor: Doyle W. McCullough, 26603 I.H. 45 North, The Woodlands, Tex. 77380

[21] Appl. No.: 892,266

[22] Filed: Aug. 4, 1986

Related U.S. Application Data

[63] Continuation-in-part of Ser. No. 641,577, Aug. 16, 1984, Pat. No. 4,619,335.

[51] Int. Cl.[4] ..... E21B 10/18; E21B 10/60

[52] U.S. Cl. ..... 175/339; 175/340; 239/101

[58] Field of Search ..... 175/317, 323, 331, 339, 175/340, 393, 422; 239/383, 101

[56] References Cited

U.S. PATENT DOCUMENTS

| | | | |
|---|---|---|---|
| 2,873,092 | 2/1959 | Dwyer | 175/61 |
| 2,945,678 | 7/1960 | Boudreaux et al. | 175/317 |
| 3,216,514 | 2/1962 | Nelson | 175/238 |
| 3,360,057 | 12/1967 | Anderson | 175/67 |
| 3,416,613 | 12/1968 | Henderson | 173/57 |
| 3,704,966 | 12/1972 | Beck, Jr. | 239/101 |
| 3,748,953 | 7/1973 | Godfrey | 239/101 |
| 3,762,648 | 10/1973 | Deines et al. | 175/383 |
| 3,801,019 | 4/1974 | Trenary et al. | 175/383 |
| 3,897,836 | 8/1975 | Hall et al. | 175/93 |
| 4,022,285 | 5/1977 | Frank | 175/65 |
| 4,071,097 | 1/1978 | Fulop et al. | 175/56 |
| 4,077,482 | 3/1978 | Ioannesian et al. | 175/340 |
| 4,079,891 | 3/1978 | Kwan | 239/101 |
| 4,081,135 | 3/1978 | Tomaro | 239/102 |
| 4,083,417 | 4/1978 | Arnold | 175/393 |
| 4,101,075 | 7/1978 | Heitzman | 239/101 |
| 4,102,418 | 7/1978 | Kammerer, Jr. | 175/324 |
| 4,102,419 | 7/1978 | Klima | 175/371 |
| 4,114,705 | 9/1978 | Milan | 175/340 |
| 4,126,194 | 11/1978 | Evans | 175/340 |
| 4,131,233 | 12/1978 | Koenig | 239/381 |
| 4,137,975 | 2/1979 | Pennock | 175/65 |
| 4,185,706 | 1/1980 | Baker, III et al. | 175/340 |
| 4,187,921 | 2/1980 | Garner | 175/340 |
| 4,189,014 | 2/1980 | Allen et al. | 175/339 |
| 4,254,914 | 3/1981 | Shames et al. | 239/383 |
| 4,262,757 | 4/1981 | Johnson, Jr. et al. | 175/67 |
| 4,361,282 | 11/1982 | DiVito | 239/383 |
| 4,389,071 | 6/1983 | Johnson, Jr. et al. | 299/14 |

OTHER PUBLICATIONS

Baker, William, Drilling, Jul. 1983, "Innovations in Rock Bit Design Hydraulics", pp. 82–86.

Institut Francais Du Petrole, Industrial Direction "New Drilling Tools: Improved Hydraulics for Rock Bits", Nov. 1979.

"Applied Hydraulic Transients", M. Hanif Chaudhry, Van Nostrand Reinhold Company, 1979.

"Hydraulics for Engineers", Robert W. Angus, Sir Isaac Pitman & Sons, Ltd., London, 1931.

"Waterhammer Analysis", John Parmakian, Dover Publications, Inc. New York, 1963.

"An Introductory Course in College Physics", Newton Henry Black, The Macmillan Company, New York, 1941.

"Analytic Geometry", R. S. Underwood and Fred W. Sparks, Houghton Mifflin Company, Boston, 1948.

*Primary Examiner*—Stephen J. Novosad

*Assistant Examiner*—Bruce M. Kisliuk

*Attorney, Agent, or Firm*—Pravel, Gambrell, Hewitt & Kimball

[57] ABSTRACT

The enhanced flow drill bit in one embodiment includes an upper body section having a bore therein and a lower body section formed integrally with the upper body section and including three passageways to transmit fluid outwardly of the drill bit body. The passageways, when intermittently open, transmit fluid flowing downwardly through the drill bit body and outwardly of the passageways to cause a cross flow in the area of the cone-type cutters. A rotor is mounted within a bore within the upper body section to intermittently open and close passageways to provide for an intensification of flow through the remaining open passageway to create high jet impact force of fluid flowing outwardly of the drill bit body to enhance cross flow and the removal of drill cuttings. Annular internal reflective surfaces are provided to substantially utilize the effect of any transient pressure surges that are created during operation of the invention.

12 Claims, 7 Drawing Figures

ENHANCED CIRCULATION DRILL BIT

CROSS-REFERENCE TO RELATED APPLICATION

This application is a continuation-in-part of U.S. patent application Ser. No. 641,577, entitled "Enhanced Circulation Drill Bit", filed Aug. 16, 1984 U.S. Pat. No. 4,619,335.

TECHNICAL FIELD OF THE INVENTION

This invention relates to oil well or other drilling utilizing a drill bit with drilling fluid circulating therethrough.

BACKGROUND OF THE INVENTION

In order to drill an oil or gas well, it is well-known to mount a drill bit at the bottom end of a line of drill pipe, commonly known as a drill string, and to rotate the drill bit and drill string into the earth in order to drill a borehole. Typically, a drill bit consists of a drill body which supports cone-type cutters which are rotated by the rotation of the drill string in order to cause the bits to grind and cut through the earth's formations. The grinding and cutting action of the drill bit creates drill cuttings which have to be removed from the bottom of the borehole so that the drill bit can continue its grinding and cutting without bogging down. In order to remove such drill cuttings, to clean and cool the drill bits, and for other reasons, it is known to circulate a drilling fluid, commonly known as "mud", downwardly through the drill string and outwardly of the drill bit with the fluid circulating upwardly in the annular area between the drill string and the borehole walls thus returning to the earth's surface. Upon return to the earth's surface, the drilling fluid is cleaned for re-circulation.

The importance of efficient removal of the drill cuttings cannot be over emphasized. Without efficient removal of the cuttings, the drill bit tends to re-grind the drill cuttings and thus lose efficiency. Efficiency of operation of the drill bit is directly proportional to the effectiveness of the removal of drill cuttings.

A number of attempts have been made to enhance removal of drill cuttings. U.S. Pat. No. 3,216,514 of Nelson discloses a rotary drilling apparatus having a valve means in the drill bit housing which is rotated in response to rotation of the drill bit cones due to the mechanical interconnection between the drill bit cones and the valve means. The valve means opens and closes passageways in the drill bit body in order to, as is taught in the patent, interrupt flow of fluid in the bit in order to cause a sudden downward force or water hammer effect to be exerted on the bit to increase the pressure of cutters on the formation and to reduce the hydrostatic pressure exerted by the fluid on the formation whereby the cuttings will be more readily broken away from the formation and entrained in the drilling fluid to be carried upwardly through the annulus. U.S. Pat. No. 4,114,705 of Milan discloses a drill bit utilizing two opposed pulsed jets 180° out of phase which is achieved by utilizing a pivotally mounted ball which oscillates between two positions to respectively close off one of two outlet ducts leading to the nozzles to produce alternating pulsed flow. U.S. Pat. No. 3,897,836 of Hall and Clipp discloses the utilization of a hammer and piston internally mounted in a housing above the drill bit to cause continuously supplied compressed air to cyclically operate the hammer and piston to create a pulsed jet of water. Other attempts to enhance the removal of drill cuttings include the use of nozzles having certain flow restriction characteristics and extended tubes extending downwardly from the bit housing to enhance cross flow. It has also been taught to combine extended nozzles with return conduits to enhance cross flow.

Further, general fluid flow technology teaches that a sudden halt to fluid flow, for example, in a pipe by the closing of a valve, can cause a rise in pressure and creation of pressure waves that travel upstream to reverberate off of any reflecting surface, and are commonly known as hydraulic transients.

While many attempts have therefore been made to enhance circulation of drilling fluid outwardly of the drill bit in order to remove drill cuttings, it is believed that the state of the art may yet be improved.

SUMMARY OF THE INVENTION

It is the object of this invention to provide a new and improved enhanced circulation drill bit adapted to be mounted at the end of the drill string for enhancing the removal of drill bit cuttings from the bottom of the borehole being drilled. It is another object of this invention to provide a new and improved means for intermittently concentrating the flow of drilling fluid through the drill bit in order to increase the jet impact force of the fluid. It is a further object of this invention to provide an enhanced circulation drill bit which provides intermittently delivered high velocity flow downhole while substantially utilizing part of the effects of the hydraulic transients which are created.

The enhanced circulation drill bit includes a drill body having an upper body section adapted to be attached to a drill string and a lower body section having thereon a drill bit. The upper body section has a bore therein in fluid communication with the drill string in order to receive circulating drilling fluid. The lower body section includes a plurality of passages which extend from the bore of the upper body section and terminate outwardly of the lower body section in proximity to the drill bit cones. A flow response means is mounted for rotation within the bore of the upper body section for intermittently opening and closing off flow through the passages in response to the velocity of the circulating drilling fluid in order to deliver intermittent high velocity flow downwardly and outwardly of the drill bit to enhance cross circulation and removal of drill cuttings.

In an additional embodiment, means are provided for utilizing a substantial part of the hydraulic transients which are created due to the intermittent opening and closing off of flow through the passage in the lower body section.

This description of this invention is intended as a summary only. The patentable features of this invention will be described in the claims and the structure and function of the drill bit of this invention will be described in the description of the preferred embodiment to follow.

DESCRIPTION OF THE PREFERRED EMBODIMENT

Figure 1:
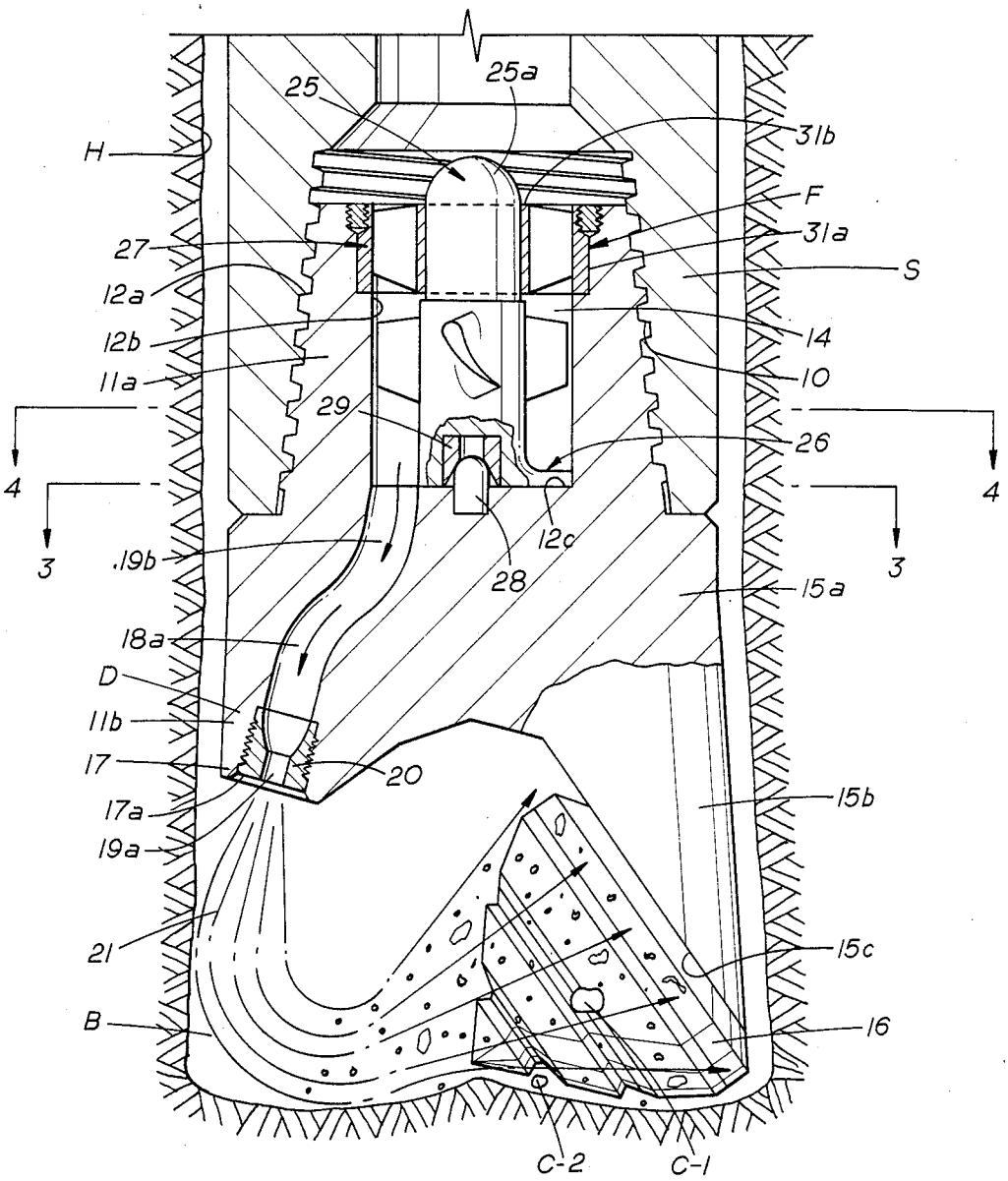
FIG. 1 is a side view partly in section of the enhanced flow drill bit of one preferred embodiment of this invention illustrating schematically the enhanced cross flow provided by this embodiment of the invention.
Figure 7:
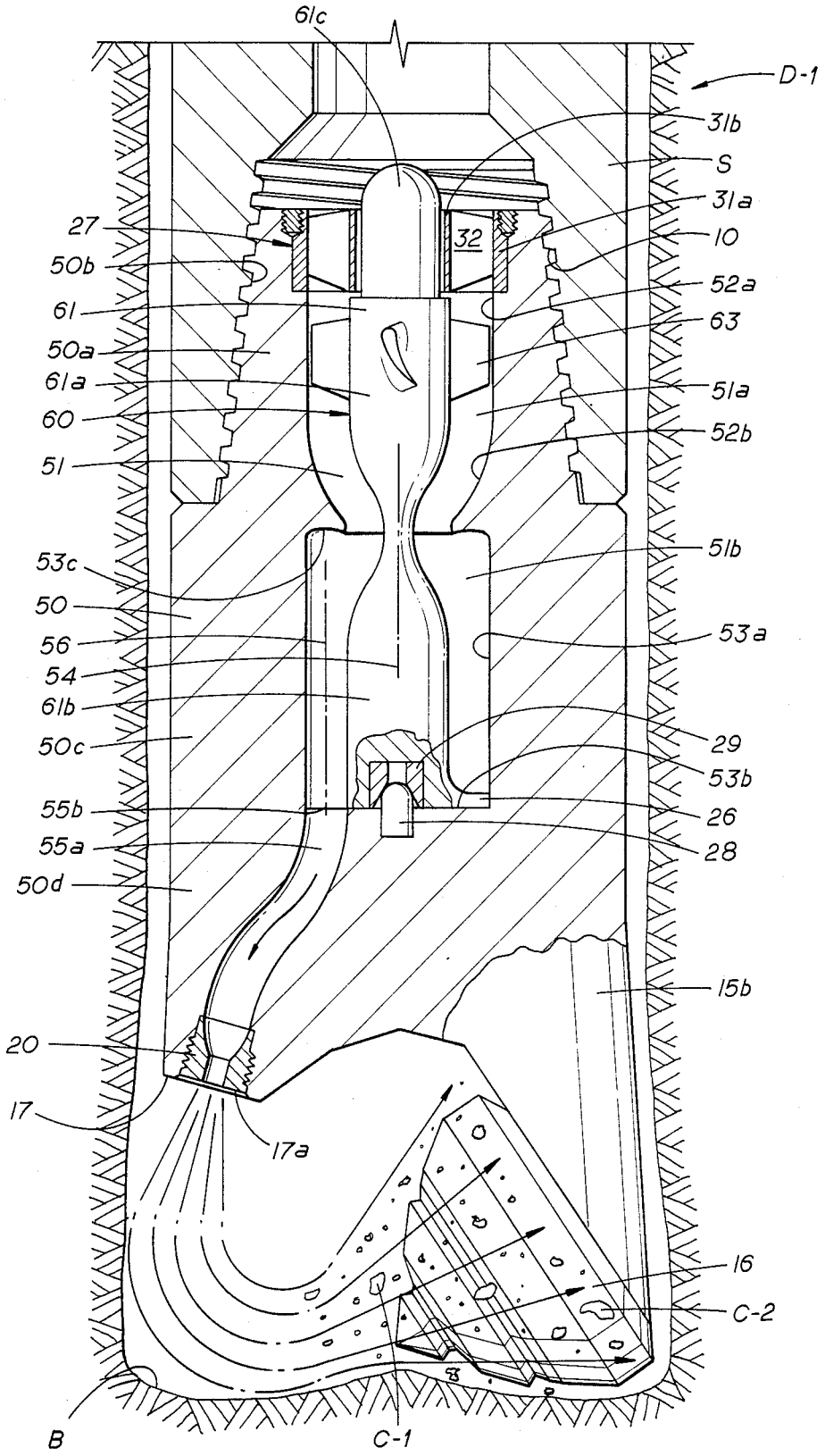
FIG. 7 is a side view partly in section of another embodiment for an enhanced flow drill bit including means for substantially utilizing part of the effects of the hydraulic transients that are created.

Referring to the drawing and in particular to FIG. 1, the enhanced circulation drill bit D is illustrated in operating position at the bottom B of the borehole generally designated as H. An additional embodiment D-1 for an enhanced circulation drill bit is illustrated in FIG. 7 and will be described after drill bit D is fully described. The drill bit D is mounted at the end of a drill string which is generally designated as S. Typically, the drill string S consists of a series of drill pipes screwed together to provide a mechanical connection and internal passageway from the drilling rig at the surface down to the bottom of the drill string and to the drill bit D attached at the end of the drill string. The actual final joint of the drill string S may be a drill bit coupling joint or a heavier type of drill pipe known as drill collar. Whether the end of drill string S is typical drill pipe, a drill bit coupling or joint or drill collar, each of these types of joints terminate in an internally threaded "box" end portion designated as 10. The enhanced circulation drill bit D of the preferred embodiment of this invention is threadedly attached to the internally threaded end portion 10 of the drill string S. This drill string type S includes an internal bore extending all the way from the surface rig down to the drill bit to allow for the flow of drilling fluid downwardly into the drill bit D in a well-known manner.

The enhanced circulation drill bit D of the preferred embodiment of this invention is provided for enhancing the removal of drill bit cuttings such as C-1 and C-2 which have been ground and/or cut out of the earth by the drill bit D. The drill bit D includes an upper or first generally cylindrical body section 11*a* and a lower or second generally cylindrical body section ll*b* formed integrally with the upper body section 11*a*. The upper body section 11*a* is frusto-conical and has an outer, upper and inwardly tapered surface 12*a* threaded for threaded engagement with the internally threaded end portion 10 of the bottom of the drill string S. The upper body section 11*a* further includes an internal bore 14 formed by cylindrical internal wall 12*b*, the bore wall 12*b* terminating in a bottom circular flat surface 12*c*. The bore 14 is formed by the internal cylindrical wall 12*b* and bottom circular wall 12*c*.

The lower body section 11*b* is integrally formed with the upper body section 11*a* and includes a generally cylindrical main lower body portion 15*a* having three circumferentially spaced support legs such as 15*b* depending downwardly from the main lower body portion 15*a*. Referring to FIG. 1, only support leg 15*b* is actually shown but it is understood that there are three support legs such as 15*b* circumferentially spaced 120° apart about the bottom of the main lower body port 15*a*. In a manner known in the art, each of the support legs such as 15*b* has a cone-type cutter 16 mounted onto an internal support surface 15*c* for rotation in response to rotation of the drill string S. Typically, the cone-type cutters 16 are mounted by sealed bearings to provide for rotation and engagement of the drill bit against the earth in response to rotation of the drill string. Although there are many patents directed to various features of the mounting of cone-type cutters, the reader is referred for the purposes of example only to the previously mentioned U.S. Pat. Nos. 3,216,514; 4,114,705 and 3,897,836 all which disclose various bearings and seals for mounting the cone-type cutters.

The lower body section 11*b* further includes three circumferentially spaced nozzle landings such as 17 which extend downwardly and provide a bottom nozzle face 17*a* in between each of the depending support legs 15*b* for the cone-type cutters 16. Three passageways such as 18*a–c* are formed into the lower body section 11*b* for providing the fluid communication between the upper body section bore 14 and the bottom B below the drill bit D. Each of the passageways 18*a* illustrated in FIG. 1 and 18*a–c* illustrated in FIG. 3 terminate at their upper end opening 19*b* into the circular bottom 12*c* of the upper body section bore 14. The passageways 18*a–c* each extend in a generally "S" direction in cross-section (FIG. 1) downwardly and terminate in an opening 19*a* in the landing faces such as face 17*a* of each of the three landings such as 17. The passages are round in cross-section and have mounted at their lower end 19*a* a constricting flow nozzle insert 20 which includes an outer portion of constricted diameter to increase the velocity of fluid exiting through each passageway. The flow of fluid outwardly from the passageway 18*a* of FIG. 1 is schematically illustrated by a series of directional arrows 21. Fluid is circulated through passageways 18*a–c* down into the area around the cone-type cutters such as 16 and then upwardly in the recessed area between the three depending support legs such as 15*b*.

If the drill cuttings such as C-1 are not sufficiently removed, the drill cuttings tend to be re-ground by the drill bit thus creating inefficiency and loss of effective penetration. However, the drill bit D of the preferred embodiment of this invention further includes a flow response means generally designated as F mounted in the upper body section bore 14 for intermittently opening and closing the passageways 18*a–c* in some combination in response to the velocity of fluid entering the upper body section bore 14 in order to provide for the delivery of intermittent high velocity flow outwardly of one or more of the nozzles 18*a–c* to enhance cross circulation and removal of drill bit cuttings out of the path of the rotating drill bit D.

The drilling fluid typically circulates downwardly through the passageway in the drill string S and through a drill bit such as D and outwardly of variously placed nozzles. In the embodiment illustrated, the fluid circulates downwardly through the passageway in the drill string S through the upper body section bore 14 of the drill bit D and outwardly through the passageways 18*a–c* into the newly created borehole area bottom B wherein the cone-type cutters 16 are cutting into the earth's formations. The flow response means F is provided for alternately opening and closing flow through one or more of the openings 18*a–c*, in order to cause a channeling of flow at increased pressure and velocity through various of the passages 18*a–c*. The flow response means F includes a rotation means generally designated as 25 mounted within the upper body section bore 14 for rotating therein in response to the flow of fluid entering the bore. The rotation means includes a flow blocking means illustrated in particular in FIGS. 4–6 and generally designated by the number 26 mounted with the rotation means 25 for rotation therewith. The flow blocking means 26 provides for the intermittent blocking of the flow into two, but less than all of the passageways 18*a–c* from the upper body section bore 14 as the rotation means 25 rotates. A flow director means generally designated as 27 is mounted upstream of the rotation means for directing fluid flow against the rotation means 25 to cause rotation of the rotation means.

The rotation means 25 is a cylindrically-shaped rotor 25*a* having a rounded upper end. The rotation rotor 25*a* is cylindrical in configuration such that an annular space is created between the outside surface of the rotor 25*a* and the internal wall 12*b* of the upper body section bore 14. The rotation rotor 25*a* is mounted for rotation within the bore 14 by a thrust and radial bearing mounting member 28 which is mounted into the lower body section and extends upwardly at the center of the circular bottom face 12*c* of the bore 14. This mounting member 28 receives a support bearing 29 which is mounted in a recess in the bottom portion of the rotor 25*a* whereby the bearing support member 25 and the thrust and radial bearing mount member 28 cooperate to provide means mounting the rotor for rotation.

Figure 2:
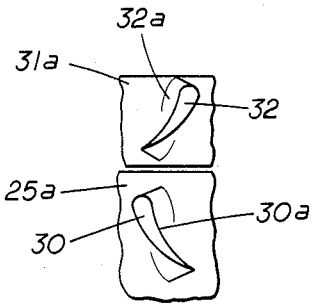
FIG. 2 is a side view of the static and rotating vanes utilized in the flow director and rotation means of this embodiment of this invention.

Referring to FIGS. 1 and 2, rotor 25*a* has mounted thereon a plurality of circumferentially spaced vanes 30 which extend radially outwardly from the outside surface of the rotor 25*a* into the annular area between the rotor 25*a* and the bore wall 12*b*. The vanes 30 are circumferentially spaced about the rotor 25*a* and include a fluid impinging surface 30*a* which receives fluid flow that drives the vanes and imparts rotational motion to the rotor 25*a*.

The flow director means 27 comprises first and second concentric stationary mounting rings 31*a* and 31*b* having welded or otherwise attached between the mounting rings a plurality of static vanes 32 which thus extend radially between the mounting rings 31*a* and 31*b*. Each of the vanes 32 includes a fluid impinging surface 32*a* which is inclined in a direction opposite to the fluid impinging surface 30*a* of the rotor vanes 30 whereby fluid is directed by the static vanes surfaces 32*a* in a direction to impinge against the rotor vane surfaces 30*a* in order to cause rotation of the rotor 25*a*. The concentric mounting rings 31*a* and 31*b* cooperate with the static vanes 32 connected there between to provide a static vane mount means fixedly attaching the vanes 32 for directing fluid flow against the rotor vanes 30. Set screws are provided for threadedly engaging the outer mounting ring 31*a* and the upper portion of the upper body section 11*a* for holding the mounting rings 31*a* and 31*b* in position. Therefore, the static vanes 32 are mounted in the annular space between the rotor and the internal cylindrical wall 12*b* of the bore 14 to direct fluid entering the annular space downwardly and at an angle of incline to directly impinge upon the rotor vanes 30 and cause rotation of the rotor. The static vanes create a directional vortex of flow to direct against the vanes of the rotor and then continue downwardly in the annular space between the rotor 25*a* and bore wall 12*b* toward the first openings 19*b* of the passages 18*a–c*.

Figure 4:
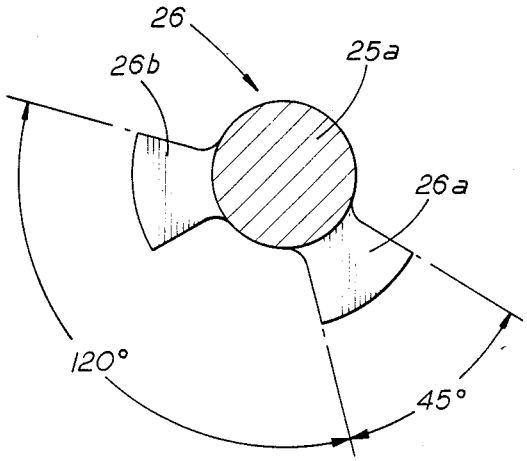
FIG. 4 is a sectional view through the rotor of the rotation means through a plane along line 4—4 of FIG. 1 illustrating the arc size and location of flow blocking element.
Figure 5:
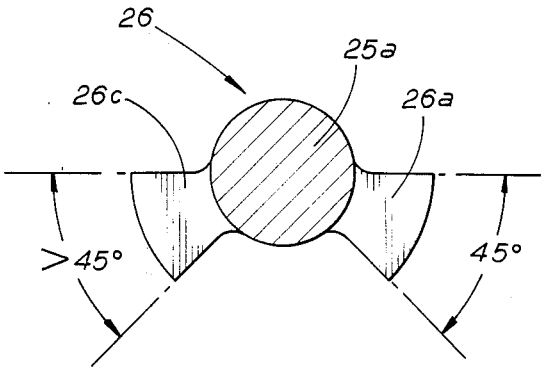
FIG. 5 is a view similar to FIG. 4 illustrating a variation in the location and size of the flow blocking element.
Figure 6:
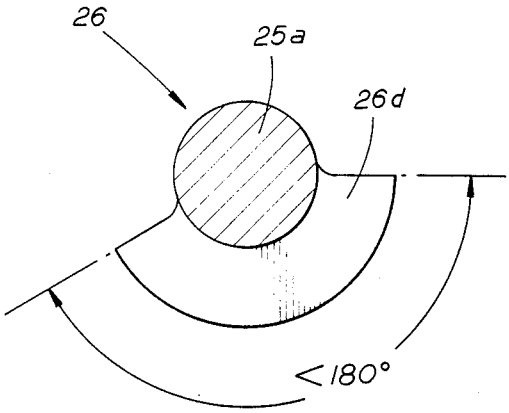
FIG. 6 is a view similar to FIGS. 5 and 4 illustrating another variation in the size of the flow blocking element.

Flow blocking means generally designated in FIG. 1 as 26 are mounted onto the bottom of rotor 25*a* and extend radially outwardly from the rotor into the annular space between the rotor and the interior wall 12*b* of the bore 14 for rotation with the rotor and intermittent blocking of one or more of the passageways 18*a–c*. Referring to FIGS. 4–6, various configurations for the flow blocking means 26 are provided. The flow blocking means includes one or more radially extending flanges or lobes such as 26*a* and 26*b* in FIG. 4 which extend radially outwardly into the annular space between the rotor 25*a* and the internal bore wall 12*b*. Referring to FIG. 4, the lobes 26*a* and 26*b* each have a circumferential arc of approximately 45° . The two lobes are spaced apart a circumferential arc of 120° . In operation, rotation of the rotor 25*a* will cause the lobes 26*a* and 26*b* to cover two of the ports 18*a–c* at one time thereby concentrating flow in the remalning open passageway and thus increasing the pressure in the remaining open passageway to cause an intensification of the resultant flow through this passageway. This intensification causes an effect which enhances cross flow of the drilling fluid leaving the temporarily open passageway such as 18*a* illustrated in FIG. 1 thereby enhancing cross flow in the direction of arrows 21 and removal of cuttings such as C-1 and C-2.

Referring to FIG. 5, an alternate design for the flow blocking means 26 is illustrated which includes a lobe 26*a* having the 45° circumferential arc and a lobe 26*c* having greater than a 45° arc. Referring to FIG. 6, a single lobe 26*d* is illustrated which has a circumferential arc greater than 120° but less than 180°. In each instance, rotation of the rotor 25*a* will cause alternate opening and closing of the passageways 18*a–c* in some combination to thereby concentrate flow througn less than all three openings intermittently to cause pressure and velocity concentration through the remaining openings such as 18*a* to thereby create cross flow and cause a greater impact of the fluid against the bottom of the borehole to further enhance drilling. It is within the scope of this invention to utilize various numbers and arc sizes of lobes to create various combinations of pressures and velocities as necessary to operate under varying drill conditions.

The advantages of this invention can be described in terms of the following formulas recognized to apply to downhole drilling fluid circulation. The mud flows through the drill string to the drill bit at constant volume due to positive displacement pumps. Therefore, whenever all of the flow is channeled through one bore, the flow rate remains constant and therefore in accordance with the following formula, the jet velocity of the channelized flow increases due to the decrease in $A_n$:

$$V_n = 0.32086\ Q/A_n$$

Accordingly, the increase in the jet velocity results in an increase in the jet impact force as follows:

$$I_f = 0.000516\ p\ Q\ V_n$$

Nomenclature:

Q=Circulation Rate (gpm)

p=(rho) Mud Weight (lb/gal)

$A_n$=Area of Nozzle ($in^2$)

$V_n$=Jet Velocity (ft/sec)

$I_f$=Jet Impact Force (lb)

In this manner, the maximum hydraulic energy available from the constant volume flow is obtained resulting in a greater impact and velocity and a greater circulation of cuttings outwardly through the annulus through the intermittent application of the mud flow outwardly of the single nozzle. The increased force of impact and increased velocity hitting the bottom of the hole causes a deflection within the hole which further enhances the cross-flow.

Referring now to FIG. 7, a second embodiment D-1 for an enhanced circulation drill bit is illustrated. This second embodiment is identified as D-1 and where ever applicable, the same numbers and letters will be used to describe this second embodiment D-1 as were used to describe the first embodiment D.

It has long been known that the sudden stopping of a flow of fluid, such as through an immediate closing of a valve, may cause the pressure to rise not only as a result of the valve closure itself but also as a result of the creation of hydraulic transients. Such hydraulic transients are pressure waves that are created by the sudden closing of a valve and reverberate upstream to reflect off of any reflecting surface. Such hydraulic transients may be created in the drill bit D due to the sudden closing off of any of the passageways 18*a*–18*c*, thus causing hydraulic transients to travel within tne internal bore 14. The second embodiment D-1 for an improved enhanced circulation drill bit is designed with the principal features of the first embodiment D and additionally includes means for substantially utilizing part of the effects of the reverberating pressure surges which are caused by the flow blocking of any of the passages within the tool body.

Referring to FIG. 7, the embodiment D-1 is adapted to be attached to the drill string S in a manner similar to the embodiment D. The drill string S includes female or box type threads 10 for receiving the body generally designated as 50 of the drill bit D-1. The body 50 includes an upper body section 50*a* which is frustro-conical and has an outer, upper and inwardly tapered surface 50*b* which is threaded to be screwed into threaded engagement with the internal threads 10 for the drill string S. The body 50 further includes an intermediate body section 50*c* and an lower body section 50*d*. The body sections 50*a, c* and *d* are integrally formed and are typically machined from a forged, steel member.

Similar to lower body section 11*b* of embodiment D, the lower body section 50*d* includes three circumferentially spaced support legs 15*b* downwardly depending from the main lower body section 50*d*. Referring to FIG. 7, only the support leg 15*b* is actually illustrated but it should be understood that there are three such support legs such as 15*b* circumferentially spaced 120° apart about the bottom of the lower body section 50*d*. As is known in the art, each of the support legs such as 15*b* includes a cone-type cutter 16 mounted by sealed bearings to provide for rotation and engagement of the drill bit D-1 against the earth in response to rotation of the drill string S.

The lower body section 50*d* includes three circumferentially spaced nozzle landings 17 which extend downwardly and provide a bottom nozzle face 17*a* in between each of the depending support legs 15*b*.

A bore generally defined as 51 is machined internally of the upper and intermediate body sections, 50*a* and 50*c*, to provide fluid communication between the bore in the drill string and the bottom of the bore hole in a manner to be further described hereinafter. The internal bore 51 includes an upper bore section 51*a* generally located in the upper body section 50*a* and a lower or intermediate bore section 51*b* generally located in the intermediate body section 50*c* of the drill bit. The upper bore section 51*a*, as viewed in the cross section of FIG. 7, includes a generally cylindrical portion 52*a* which joins a converging inverted, frustro-conical surface portion 52*b*. The intermediate internal bore portion 51*b* is formed of a generally cylindrical wall 53*a* which terminates in a bottom circular face 53*b*. The intermediate bore section 51*b* further includes an upper outer rim or ledge which is generally designated as 53*c* which is annular in configuration and joins to the inverted frustro-conical internal bore portion 52*b*. The internal diameter of the cylindrical wall portion 53*a* of the intermediate or lower bore 51*b* is approximately equal to the diameter of the cylindrical portion 52*a* of the upper bore 51*a*. For purposes of definition, the entire body 50 as well as the bore sections 51*a* and 51*b* have a center line 54.

Figure 3:
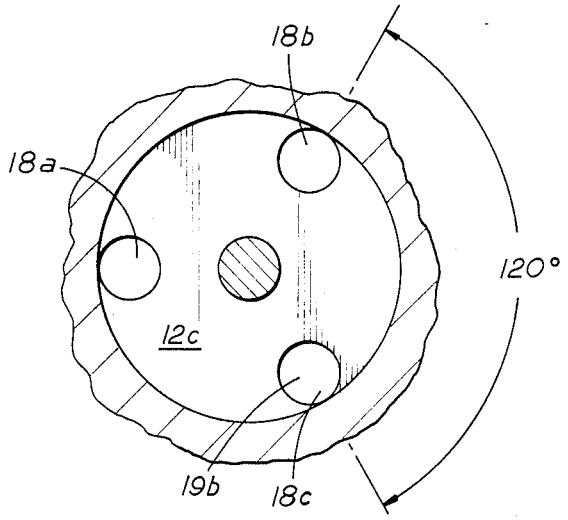
FIG. 3 is a sectional view taken along line 3—3 of FIG. 1 illustrating the circumferential spacing of the three passageways through the lower section of the drill bit body.

A plurality of three passageways such as 55*a* extend from the bottom face 53*b* of the intermediate bore 51*b* through the lower body portion 50*d* and open to the surfaces of the land 17. In the cross sectional view of FIG. 7, it is seen that the passageway 55*a* is generally S-shaped and is provided to provide fluid communication from the internal bore sections 51*a* and 51*b* through the remainder of the tool body downwardly to the bore B of the borehole. As best illustrated with respect to the embodiment D, there are three passageways but only passageway 55*a* is illustrated in FIG. 7; however, it should be understood that there are three passageways which are circumferentially spaced 120° wih respect to each other in a manner similar to passageways 18*a*–18*c* as illustrated in FIG. 3 with respect to the first embodiment D. Each of the passageways 55*a* terminate in a nozzle 20 as previously described with respect to the first embodiment D. Each of the passageways such as 55*a* is cylindrical in cross section such as illustrated with respect to FIG. 3 and thus each passageway has a center point 55*b* in the plane of bottom face 53*b*.

The annular ledge 53*c* of the intermediate internal bore section 51*b* will now be particularly described. In the cross sectional view of the annular surface 53*c* illustrated in FIG. 7, two sections of the surface 53*c* are actually illustrated. The configuration of each of said surfaces is a parabolic reflecting surface or paraboloid. The parabolic surface 53*c* is a segment of a parabolic curve generated according to the formula for a parabola $$y^2=4ax$$

wherein a is the focal point of the parabola and x and y are coordinates. The "x" coordinate is actually parallel to center line 54 and the "y" coordinate is perpendicular thereto. For the purposes of generation of the parabolic surface 53*c*, the focal point a is the distance along line 56 between the center point 55*b* of the intersection of opening 55*a* with bottom bore surface 53*c* to the vertex for the parabolic curve of surface segment 53*c*. This distance is illustrated by line 56, sometimes known as the axis, with respect to the passageway 55*a*. The parabolic surface which is illustrated in two portions in the cross-sectional view of FIG. 7 is then generated as an annular surface about bore center line 54. The purpose of the annular, parabolic surface is to provide a reflecting surface to receive transient pressure surges and reflect some of the transient pressure surges to the focal point 55*b* of the passageway 55*a*. In this manner, a portion of the transient pressure surges are reflected back into the passageway such as 55*a* for transmission outwardly of the passageways unless blocked.

The flow director means 27 is also utilized in the embodiment D-1. The flow director means 27 includes first and second concentric, stationary mounting rings 31*a* (outer) and 31*b* (inner) having welded or otherwise attached between the mounting rings a plurality of static vanes 32 which thus extend radially between the mounting rings 31*a* and 31*b*.

A flow rotation means generally designated as 60 is a rotor 61 which is mounted within the bore sections 51*a* and 51*b* for the purpose of rotating in response to fluid passing through the flow director means 27. The rotor 61 has the general configuration of an hour glass and includes an upper portion 61*a* and a lower portion 61*b*. The upper portion 61*a* terminates in an upper dome-shaped or rounded upper end 61*c* which fits within the inner concentric ring 31*b* of the flow director means 27. The upper rotor portion 61*a* is generally cylindrical in configuration and converges to an intermediate point of smallest diameter located generally in the plane of intersection between the upper bore 51*a* and the lower bore 51*b*, which is generally a plane which passes through the annular parabolic surface 53*c*. The lower rotor portion 61*b* completes the hour glass configuration and includes an upper portion of reduced diameter and a lower portion which is generally cylindrical. The lower portion 61*b* of the rotor terminates in flow blocking lobes generally designated by the number 26, which are identical to the flow blocking means and lobes previously described with respect to the embodiment D. Further, the mounting of the rotor 61 is similar to the mounting of the rotor 25 of embodiment D and therefore the rotor 61 is mounted for rotation within the lower bore section 51*b* by a thrust and radial bearing mounting member 28 which is mounted into the lower body section and extends upwardly at the center of the circular bottom face 53*b* of the bottom bore section 51*b*. The mounting member 28 receives a support bearing 29 which is mounted in a recess in the bottom portion of the bottom rotor section 61*b* whereby the rotor 61 is mounted for rotation by the radial mount member 28 at the bottom and at the top by the internal cylindrical wall of the inside concentric ring 31*b*. Rotor 61 includes a plurality of vanes 63 positioned circumferentially about the upper rotor section 61*a* and angled so as to rotatingly drive the rotor in response to fluid flow in a manner similar to the rotational movement described with respect to the rotor 25 of the embodiment of FIG. 1 as illustrated in particular in FIG. 2.

It has previously been described, with respect to operation of the embodiment of FIGS. 1–6, that the enhanced flow drill bit D is designed to channel substantially all the flow through one of the passageways 18*a–c* for the purpose of concentrating flow to cause pressure and velocity concentration and thereby create a greater cross flow and a greater impact of the fluid against the bottom of the bore hole B to further enhance drilling. The configurations for the lobes of the flow blocking means 26 have previously been described with respect to FIGS. 3–6. Under the various configurations, flow is channeled intermittently through one or more passageways as other passageways are blocked by the location of a lobe section such as 26*c* in FIG. 5 over a passageway. Turning now to the present embodiment, when a lobe such as 26*c* is positioned over a passageway such as 55*a* and flow is blocked through the passageway, pressure surge waves are created which travel upstream and reflect off of the annular, parabolic surface 53*c*. Such pressure surges can reverberate between reflecting surfaces any number of times, until dissipated, and some of these will enter passageway openings 19*b* that are not blocked at the moment to further enhance flow through passageways 55*a–c*.

The creation of transient pressure surges or pressure waves tends to increase the pressure caused by the blocking of flow through one or more passageways such as 55*a*, according to the following formula, $$a=\sqrt{k/p}$$

$$\Delta H=-a/g\Delta V$$

wherein:

a = velocity of pressure wave (ft/sec)
K = bulk modulus of fluid (lb/ft$^2$)
p = Rho, density of fluid (lb/ft$^3$)
Δ = change
H = pressure (head in feet)
g = acceleration of gravity (ft/sec$_2$)
V = velocity of fluid (ft/sec).

According to these formulas, pressures and flow velocities within the bores 55*a–c* are increased not only because of the blocking off of flow through the passageways but also because of the induced created pressure surges.

The annular parabolic surface 53*c* which extends radially inwardly from the cylindrical wall 53*a* of the intermediate bore section 51*b* is provided to receive and reflect such pressure surges or waves downwardly (as viewed in the figure) and to focus such waves at the focal point 55*b* located in the center of each passageway such as 55*a*. Such annular surface 53*a* is in general axial alignment with said circumferentially positioned passageways. The focusing of such pressure waves at 55*b* is accomplished due to the scientifically established fact that parabolic surfaces reflect parallel waves back to the focal point of a parabolic surface. By constructing the annular parabolic surface segment 53*a* about a focal point at the center of each of three passageways such as 55*a*, a portion of the pressure surges are reflected back to such focal points and thus outwardly of such passageways when they are opened. In this manner, some of the hydraulic transients within the intermediate bore 51*b* are directed through the passageways 55*a–c* thereby creating a greater efficiency of channelization of the flow outwardly of the body. Such greater channelization of the flow thus provides for more efficient cross flow and more efficient circulation of cuttings outwardly through the annulous during drilling operations.

The foregoing disclosure and description of the invention are illustrative and explanatory thereof, and various changes in the size, shape and materials, as well as in the details of the illustrated construction may be made without departing from the spirit of the invention. For example, the type of drill bit body illustrated in the drawings is a cone-type bit body having three dependent legs. The embodiments of this invention are applicable to other types of drill bit bodies which are generally cylindrical such as diamond bits and the newer polycrystalline diamond bits utilizing a series of studs having polycrystalline diamond compact surfaces.

While the drilling fluid has been described as liquid, it is within the scope or this invention to utilize a gas such as air as the drilling fluid. It should be understood that, althougn the drill bits D and D-1 of the preferred embodiments of this invention have been described with respect to a vertical borehole utilized in oil and gas well drilling, the drill bits D and D-1 may be used in variously directed boreholes for oil and gas well drilling. Additionally, the drill bits D and D-1 of the embodiments of this invention may be used in horizontal operations such as in mining and oil and gas drilling wherein drill bits are utilized to form horizontal boreholes.

I claim:

1. An enhanced circulation drill bit adapted to be mounted at the end of a drill string for enhancing the removal of drill bit cuttings from the bottom of the borehole being drilled, comprising:

a drill body having a first body section adapted to be attached to a drill string and a second body section having mounted therewith a plurality of cone-type cutters;

said first body section having a bore therein adapted to be in fluid communication with the bore of the drill string to receive drilling fluid flowing downwardly through drill string;

said second body section having at least two passageways therethrough, each of said passageways having a first and a second end opening, said passageways being in fluid communication with said bore of said first body section at said first end opening and said passageways extending through said second body section to a second end opening;

flow response means mounted in said first body section bore for intermittently opening and closing said passageways in response to the flow of fluid entering said upper body section bore in order to intermittently deliver concentrated high velocity flow outwardly of said second end of a passageway to the end of the borehole to increase jet impact force and enhance cross circulation and removal of drill bit cuttings;

said flow response means including rotation means mounted with said first body section bore for rotating therein in response to fluid entering said bore and flow blocking means mounted with said rotation means and rotating therewith for intermittently blocking flow to said passageways as said rotation means rotates; and pressure surge reflection means mounted with said bore of said first body section for substantially utilizing at least a portion of pressure surges within said bore created by said flow blocking means intermittently blocking flow to said passageways.

2. The structure set forth in claim 1, including:

flow director means for directing fluid flow against said rotation means to cause rotation thereof.

3. The structure set forth in claim 1, including:

said second body section having three passageways extending therethrough, said passageways being in fluid communication with said bore of said first body section at a first end opening, said passageways extending downwardly to a second end opening in proximity to said cone-type cutters; and said first ends of said passageways are arranged circumferentially in an annular row in said first body bore.

4. The structure set forth in claim 1, wherein:

said rotation means includes a rotor;

rotation mount means is mounted with said rotor and with said drill body for mounting said rotor for rotation in said bore of said first body section; and said flow blocking means including a flow blocking element mounted with said rotor and moving circumferentially to intermittently block off flow to one or more of said first ends of said passageways.

5. The structure set forth in claim 4, including:

said rotor having vanes mounted thereon, said vanes extending radially outwardly for implementing rotation of said rotor in response to fluid flow.

6. The structure set forth in claim 4, wherein said flow blocking element is:

a first radially extending lobe having an arc of about 45°; and a first radially extending lobe having an arc of about 45°, said second radially extending lobe being positioned about 120° from said first radially extending lobe.

7. The structure set forth in claim 4, wherein said flow blocking element is:

a first radially extending lobe having an arc of about 45°; and a second radially extending lobe having an arc of greater than 45°.

8. The structure set forth in claim 4, wherein said flow blocking element is a radially extending lobe greater than 120° but less than 180°.

9. The structure set forth in claim 4, including:

said rotor mounted for rotation in said first body section bore;

said first body section bore including first and second bore sections and said rotor being mounted in both sections;

said flow blocking elements mounted with said rotor in said second bore section; and said pressure surge reflecting means including a reflective surface in said second bore section for receiving and reflecting transient pressure surges created by said flow blocking element blocking off flow through one or more first ends of said passageways.

10. The structure set forth in claim 9, including:

said reflective surface is annular and is in generally axial alignment with said passageways.

11. The structure set forth in claim 10, including:

said reflective surface is parabolic in cross-section.

12. The structure set forth in claim 11, including said parabolic surface has as a focal point the center of the first end of said passageways.

* * * * *